US009303430B2

(12) United States Patent
Header

(10) Patent No.: US 9,303,430 B2
(45) Date of Patent: Apr. 5, 2016

(54) INTEGRATED DOOR OPERATOR HARDWARE WITH RECESSED HANDLE

(71) Applicant: Gregory Header, Richland, PA (US)

(72) Inventor: Gregory Header, Richland, PA (US)

( * ) Notice: Subject to any disclaimer, the term of this patent is extended or adjusted under 35 U.S.C. 154(b) by 0 days.

(21) Appl. No.: 14/566,904

(22) Filed: Dec. 11, 2014

(65) Prior Publication Data

US 2015/0091312 A1 Apr. 2, 2015

Related U.S. Application Data

(62) Division of application No. 13/918,081, filed on Jun. 14, 2013, now Pat. No. 9,003,843.

(51) Int. Cl.
*E05B 1/00* (2006.01)
*E05B 15/00* (2006.01)
(Continued)

(52) U.S. Cl.
CPC . *E05B 1/00* (2013.01); *E05B 1/003* (2013.01); *E05B 1/0015* (2013.01); *E05B 3/00* (2013.01);
(Continued)

(58) Field of Classification Search
CPC ..... E05B 1/00; E05B 3/00; E05B 1/0015; E05B 65/0811; E05B 63/246; E05B 1/003; E05B 15/00; E05B 65/1006; E05C 9/04; E05C 9/1875; E05C 1/16; Y10T 70/5195; Y10T 70/5177; Y10T 292/0834; Y10T 70/5832; Y10T 70/5173; Y10T 70/5248; Y10T 70/5208; Y10T 70/5159; Y10T 292/82; Y10T 70/519; Y10T 292/46; Y10T 292/63; Y10T 292/57; Y10T 292/1043; Y10T 292/7486; Y10T 16/458; Y10T 16/498; Y10T 292/0803
USPC ..... 292/5–7, 11, 32, 34, 40, 63, 66, 336.3, 292/347, 348, DIG. 46, DIG. 63; 70/95, 96, 70/97, 98, 99, 100, 103, 113, 114, 224
See application file for complete search history.

(56) References Cited

U.S. PATENT DOCUMENTS 4,099,756 A * 7/1978 Kagoura ..... E05C 3/06 292/207
4,784,417 A * 11/1988 Fleming ..... E05B 3/065 292/347

(Continued)

FOREIGN PATENT DOCUMENTS

CN 201546492 U 8/2010
CN 201635493 U 11/2010

(Continued)

OTHER PUBLICATIONS

Door Handles, accessed on the Internet at: http://www.houzz.com/door-handles/p/96 on Apr. 13, 2013.

(Continued)

*Primary Examiner* — Christopher Boswell
*Assistant Examiner* — Amanda L Miller
(74) *Attorney, Agent, or Firm* — Stone Creek Services LLC; Alan M Flum

(57) ABSTRACT

Disclosed in one aspect is the fixed door pull handle assembly that includes an elongated door pull handle with two or more support standoffs projecting away from the elongated door pull handle and securing the elongated door pull handle to the doorframe or to the body of the door. One of the support standoffs is user rotatable, and rotatably engages a door latch assembly within the door. In another aspect, the support standoff is not user rotatable. Instead, a center-pivoting handle is mounted in-line with one of the support standoffs and rotatably engages the door latch assembly within the door. The center-pivoting handle is recessed within the elongated handle.

9 Claims, 14 Drawing Sheets

(51) Int. Cl.

| | |
|---|---|
| ***E05B 63/24*** | (2006.01) |
| ***E05B 65/08*** | (2006.01) |
| ***E05C 9/04*** | (2006.01) |
| ***E05C 9/18*** | (2006.01) |
| ***E05B 3/00*** | (2006.01) |

(52) U.S. Cl.

CPC ..... *E05B 15/00* (2013.01); *E05B 63/246* (2013.01); *E05B 65/0811* (2013.01); *E05C 9/04* (2013.01); *E05C 9/1875* (2013.01); *Y10S 292/46* (2013.01); *Y10S 292/63* (2013.01); *Y10T 70/519* (2015.04); *Y10T 70/5159* (2015.04); *Y10T 70/5173* (2015.04); *Y10T 70/5177* (2015.04); *Y10T 70/5195* (2015.04); *Y10T 70/5208* (2015.04); *Y10T 70/5248* (2015.04); *Y10T 70/5832* (2015.04); *Y10T 70/7486* (2015.04); *Y10T 292/0803* (2015.04); *Y10T 292/0834* (2015.04); *Y10T 292/1043* (2015.04); *Y10T 292/57* (2015.04); *Y10T 292/82* (2015.04)

(56) References Cited

U.S. PATENT DOCUMENTS

| | | | | |
|---|---|---|---|---|
| 5,092,144 | A * | 3/1992 | Fleming | E05B 65/0811 292/244 |
| 6,626,473 | B1 | 9/2003 | Klein et al. | |
| 8,291,732 | B2 * | 10/2012 | Ramsauer | E05B 1/0092 292/32 |
| 2006/0038418 | A1 * | 2/2006 | Huizenga | E05B 77/06 292/336.3 |
| 2006/0071478 | A1 * | 4/2006 | Denys | E05B 63/12 292/26 |
| 2010/0171329 | A1 | 7/2010 | Lambrou et al. | |
| 2011/0181057 | A1 | 7/2011 | Danino | |
| 2012/0240718 | A1 | 9/2012 | Goetze | |

FOREIGN PATENT DOCUMENTS

| | | | |
|---|---|---|---|
| CN | 202000749 | U | 10/2011 |
| CN | 202788371 | U | 3/2013 |
| DE | 202006016305 | U1 | 1/2007 |
| DE | 202009012250 | U1 | 1/2010 |
| DE | 102009002419 | A1 | 10/2010 |
| EP | 1026346 | B2 | 1/2006 |
| EP | 2105554 | A1 | 3/2009 |
| EP | 2543799 | A2 | 1/2013 |
| FR | 2967187 | A1 | 5/2012 |
| JP | 2011111826 | A | 6/2011 |

OTHER PUBLICATIONS

Door Handles, accessed on the Internet at: http://www.houzz.com/long-door-handle/p/16 on Apr. 13, 2013.

Front Door Handle, accessed on the Internet at: http://www.houzz.com/front-door-handle on Apr. 13, 2013.

Front Door Handle, accessed on the Internet at: http://www.houzz.com/front-door-handle/p/32 on Apr. 13, 2013.

Sliding Door Handle, accessed on the Internet at: http://www.houzz.com/sliding-door-handle/p/16 on Apr. 13, 2013.

Sliding Door Handle, accessed on the Internet at: http://www.houzz.com/sliding-door-handle/p/232 on Apr. 13, 2013.

Long Door Pulls, accessed on the Internet at: http://www.firstimpressionsint.com/longdoorpulls.html on Apr. 13, 2013.

Italian Style Glass Door Lock, accessed on the Internet at: http://sell.lulusoso.com/upload/20120509/Italian_style_glass_door_lock.jpg on Apr. 13, 2013.

Door Handle (with lock) E01K001, ArchiExpo, GFS Glass Fixing System, accessed on the Internet at: http://www.archiexpo.com/prod/gsf-glass-fixing-system/door-handles-with-lock-62888-267623.html on Apr. 13, 2013.

Glass Door Handles GDH126, Solar International Co., Limited, accessed on the Internet at: http://solar-ok.com/product_show.asp?keyno=1534 on Apr. 13, 2013.

Glass Door Handles GDH108, Solar International Co., Limited, accessed on the Internet at: http://solar-ok.com/product_show.asp?keyno=1535 on Apr. 13, 2013.

Dorma Glas Locking Ladder Pull Catalog, Jun. 2012, Dorma Glas, Reamstown, PA.

Locking Pull System Catalog, Rockwood Manufacturing Company, Rockwood, PA, Feb. 2012.

Tubular pull handles in Stainless Steel with lock incorporated (K-Lock 200C-001), PBA, Italy, accessed on the Internet at http://www.pba.it/en/products/complements-for-doors-and-windows/pull-handles-with-lock/200c/200c-002/ on Apr. 13, 2013.

Programma K-Lock, Apr. 9, 2008, PBA, Italy.

K-Lock, lightbox photo, http://www.pba.it/en/products/complements-for-doors-and-windows/pull-handles-with-lock/200c/200c-002/.

ADA Turn Locking Pull System Enhancement, Rookwood Manufacturing Company, accessed on the Internet at: http://www.rockwoodmfg.com/whatsnew.html on Apr. 13, 2013.

* cited by examiner

INTEGRATED DOOR OPERATOR HARDWARE WITH RECESSED HANDLE

CROSS-REFERENCE

This application is a divisional of U.S. patent application Ser. No. 13/918,081 filed on Jun. 14, 2013. The entire contents of U.S. patent application Ser. No. 13/918,081 are hereby incorporated by reference.

BACKGROUND

The present disclosure relates to fixed door pull handles and door operators.

Fixed door pull handles are commonly used on sliding glass doors and entry doors to buildings. They can also be utilized for interior doors, especially when a standard turn handle does not meet aesthetic requirements. Fixed door pull handles can be found in both residential and commercial buildings. For the purpose of this disclosure, a fixed door pull handle assembly includes an elongated door pull handle with two or more support standoffs projecting away from the elongated door pull handle toward the door. The support standoffs secure the elongated handle to an integral doorframe surrounding the door or directly to the body of the door.

Fixed door pull handle assemblies often have both aesthetic and utilitarian functions, in both residential and commercial architecture where a particular style of fixed door pull handle can be used to help make an architectural statement. Doors utilizing fixed door pull handle assemblies generally utilize a separate locking or latching mechanism. This can potentially detract from the overall appearance of the door. Attempts to solve this problem, particularly in commercial glass doors, include placing the lock at the top of the doorframe out of site. While this solution makes the lock or latch less visible, it is inconvenient. For residential settings where the door is latched or locked often, it is often not practical.

SUMMARY

The present disclosure describes a fixed door pull handle assembly, in several aspects, that attempts to overcome the problems described in the Background section. The fixed door pull handle can be used for both exterior and interior doors. In one aspect, the fixed door pull handle assembly includes an elongated door pull handle with two or more support standoffs projecting away from the elongated door pull handle and securing the elongated door pull handle to the doorframe or to the body of the door. One of the support standoffs is user rotatable and rotatably engages a door latch assembly within the door. The user rotatable standoff can engage the door latch assembly by a spindle or shaft. The spindle can be embedded and hidden within a hollow interior portion of the user rotatable support. The spindle can engage the door latch assembly within the door structure. The spindle and user rotatable support standoff are configured to be in rotational captive cooperation so that when the user rotates the user rotatable support standoff, the spindle also rotates. The spindle or shaft can engage a variety of door latch assemblies. For example, a two-point, three-point, or deadbolt latch typically used for exterior doors. Alternatively, the door latch assembly can be a non-locking passage latch typically used for interior door assemblies.

In a second aspect, the fixed door pull handle assembly includes an elongated door pull handle with two or more support standoffs projecting away from the elongated door pull handle and securing the elongated door pull handle to the doorframe or to the body of the door. A center-pivoting handle is mounted in-line with one of the support standoffs and rotatably engages the door latch assembly to lock or unlock the door. The center-pivoting handle is recessed within the elongated door pull handle so that the top surface of the center-pivoting handle is either flush or below the outward facing surface of the elongated door pull handle. A spindle or shaft can be embedded and hidden within the support standoff that is in-line with the center-pivoting handle. The spindle is free to rotate within the support standoff. One end of the spindle projects into the door and engages the door latch assembly within the door body. The other end of the spindle projects into the elongated door pull handle and is secured to the center-pivoting handle. The center-pivoting handle and spindle are rotatably coupled so that when the center-pivoting handle is rotated, the door latch assembly can lock or unlock the door. As in the first aspect, the spindle or shaft can engage a variety of door latch assemblies. For example, a two-point, three-point, or deadbolt latch typically used for exterior doors. The door latch assembly can be a non-locking passage latch assembly typically used for interior door assemblies.

This Summary has introduced a selection of concepts in simplified form that are described in more detail in the Description. The Summary is not intended to identify essential features or limit the scope of the claimed subject matter.

DRAWINGS

DESCRIPTION

Figure 1:
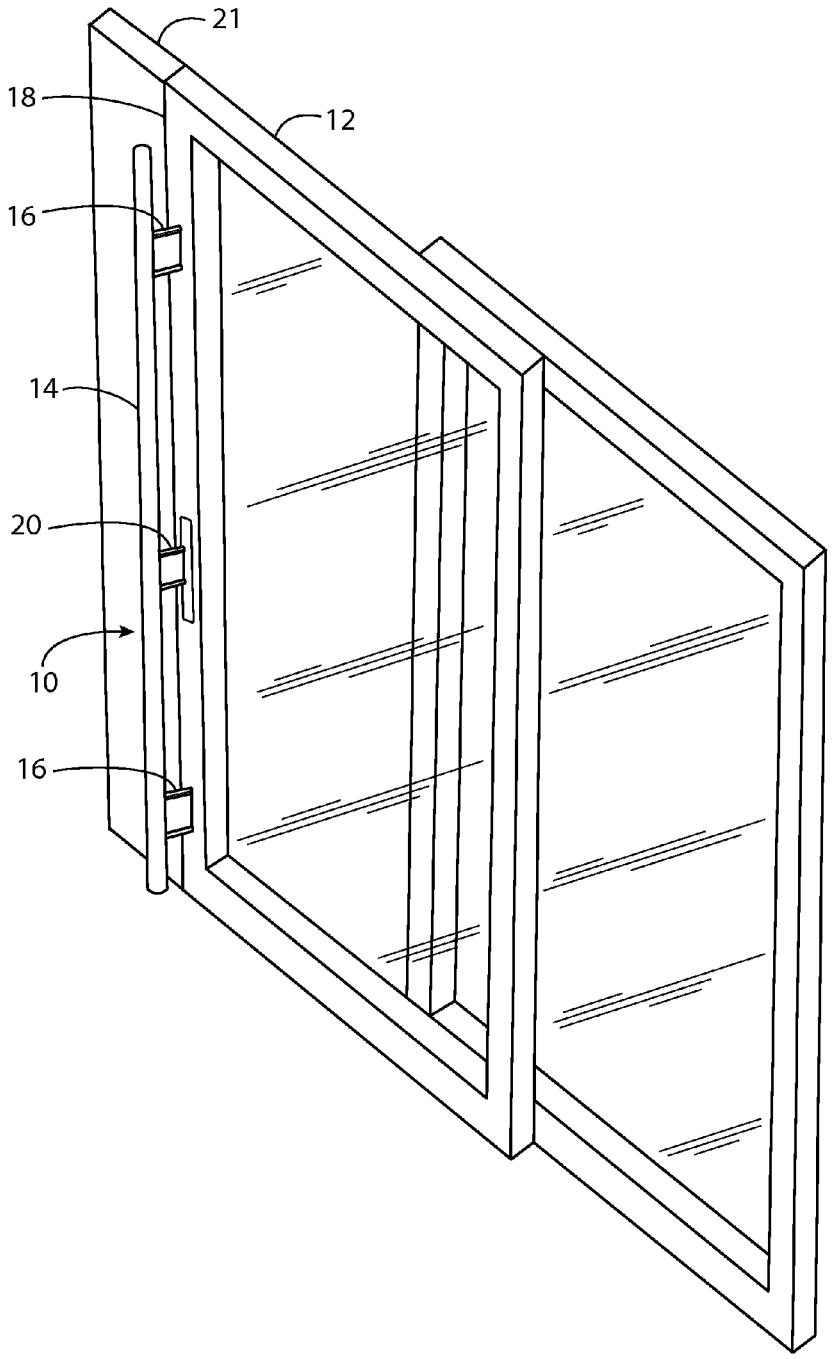
FIG. 1 shows a sliding glass door, in front perspective view, illustrating one aspect of the disclosed fixed door pull handle assembly.

The following description is made with reference to figures, where like numerals refer to like elements throughout the several views, FIG. 1 shows, in front perspective view, one aspect of the fixed door pull handle assembly 10 of this disclosure, mounted to a door 12. The door illustrated in FIG. 1 is a sliding glass door. The fixed door pull handle assembly 10 includes an elongated door pull handle 14 and fixed support standoffs 16 projecting away from the elongated door pull handle 14 and securing the elongated door pull handle 14 to a doorframe 18. For the purpose of this disclosure the use of the term doorframe refers to a framing element surrounding and integral to a door, not the framing element surrounding and integral to a wall opening for receiving a door. The doorframe 18 illustrated in FIG. 1 is integral to and surrounds the sliding glass door. An integrated locking handle in the form of a user rotatable support standoff 20 engages a latching mechanism for securing the door 12 to a doorjamb 21 or to the lintel above the door or still below the door 12.

One of the advantages of the fixed door pull handle assembly 10 disclosed is that it may be constructed from a selection of materials, styles, and shapes, to fit specific architectural and aesthetic requirements. The elongated door pull handle 14 illustrated in FIG. 1 is made of wood. The elongated door pull handle 14 can be made of other materials suitable for use as a door pull handle, for example, metal, glass, or rigid plastic. The elongated door pull handle 14 is illustrated as having a cylindrical shape. However, any shape can be used that is capable of performing the function of a door pull handle that is rigidly secured to the door 12 or the doorframe 18 using the fixed support standoffs 16. For example, the elongated door pull handle 14 can have a contoured shape for increased grip and to provide suitable styling to match specific architectural elements in the surrounding environment. The fixed support standoffs 16 are shown having a tubular rectangular shape. The fixed support standoffs 16 can be any suitable shape capable of rigidly supporting the elongated door pull handle 14 and bearing the forces imparted as the door is opened and closed.

Figure 2:
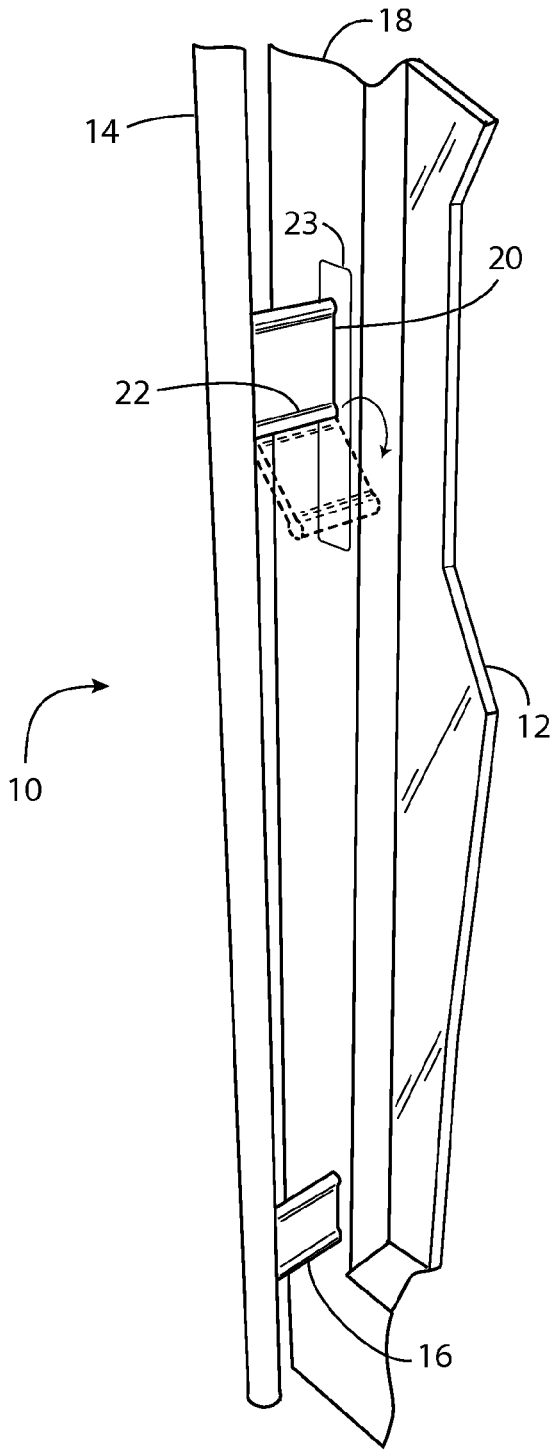
FIG. 2 shows a detailed view of a portion of the fixed door pull handle assembly of FIG. 1 illustrating a user rotatable support standoff as a latching handle.

FIG. 2 shows a detailed view of a portion of the fixed door pull handle assembly 10 of FIG. 1 showing a portion of the elongated door pull handle 14, the fixed support standoff 16, the doorframe 18, and the user rotatable support standoff 20. The user rotatable support standoff 20 is shown in use as a latching handle pivoting about a pivot portion 22 located at the bottom edge of the user rotatable support standoff 20. The user rotatable support standoff 20 of FIG. 2 rotates 180 degrees about the pivot portion 22 between resting positions. In one of the resting positions, the user rotatable support standoff 20 latches the door 12 to the doorjamb 21 of FIG. 1 or to a lintel above the doorframe 18 or to the floor or sill below the doorframe 18. In the other resting position, the user rotatable support standoff 20 unlatches the door 12 from the doorjamb 21 of FIG. 1 and allows the door to open freely. The user rotatable support standoff 20 is shown in one of the resting positions represented by solid lines and an intermediate position, just before the other resting position, represented by broken lines. The user rotatable support standoff 20 is shown engaging a cover plate 23 that is mounted to an outward facing surface of the doorframe 18. The cover plate 23 can include indicia the indicates to the user which position the user rotatable support standoff 20 is the latched or locked position and which position is the unlatched or open position. The user rotatable support standoff 20 can be optionally locked into place or "dogged down" as known in the art, in order to prevent egress. This can be accomplished, for example, by an optional custodial key lock mechanism that fixes the rotatable support standoff to the elongated door pull handle 14, the doorframe 18, or the door 12 so it cannot rotate. For example, a small key lock can be placed proximate to the standoff latching portion 24 and be used to lock the press fit plunger 36 into the elongated door pull handle 14.

Figure 3:
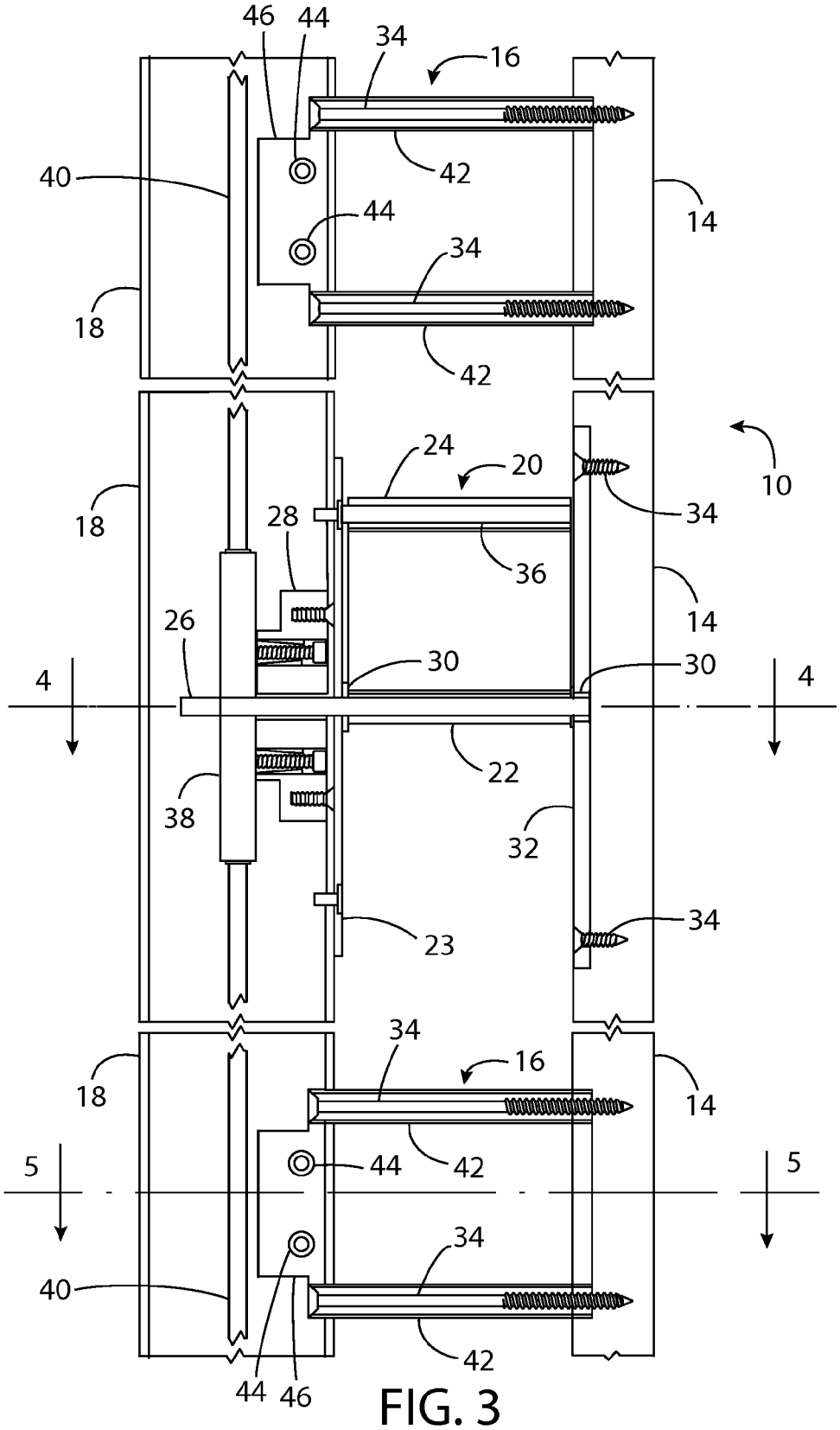
FIG. 3 shows a side view, in partial cutaway, of the fixed door pull handle assembly and user rotatable support standoff of FIG. 1.

FIG. 3 shows a side view, in cutaway, a portion of FIG. 1 of the fixed door pull handle assembly 10, including the elongated door pull handle 14, fixed support standoffs 16, one of the vertical members of the doorframe 18 the surrounds the glass glazing, and the user rotatable support standoff 20. The user rotatable support standoff 20 is shown with the pivot portion 22 and a standoff latching portion 24. The pivot portion 22 includes a hollow tube extending lengthwise, from the doorframe 18 to the elongated door pull handle 14, and proximate to the bottom edge along the user rotatable support standoff 20. A door spindle 26 extends through the hollow tube of the pivot portion 22. The exterior of the door spindle 26 and the interior of the hollow tube of the pivot portion 22 are engaged in rotational captive cooperation. As a result, as the user pivots the user rotatable support standoff 20 the door spindle 26 also rotates. The door spindle 26, as illustrated, is a square drive spindle. The interior cross-section of the hollow tube has a complementary cross-sectional shape. Other spindle exterior shapes and complementary hollow tube interior shapes can be used that provide rotational captive cooperation, for example, a half-moon shape.

One end of the door spindle 26 extends into the doorframe 18 and engages a door latch assembly 28 within the door and a bushing 30 mounted in the cover plate 23 and door latch assembly 28. The other end of the door spindle 26 extends into a bushing 30 within the elongated door pull handle 14. In FIG. 3, the bushing 30 within the elongated door pull handle 14 is mounted in a mounting plate 32. The mounting plate 32 is recessed within the elongated door pull handle 14 and secured to the elongated handle by threaded fasteners 34. The above-described arrangement allows the door spindle 26 to rotate freely within the elongated door pull handle 14 while at the same time, engaging the latching mechanism within the door latch assembly 28 as the use rotates the user rotatable support standoff 20 about the pivot portion 22. The bushing 30 is typically made of a low friction material with high dimensional stability such as an engineered thermoplastic, for example Polyoxymethylene, often sold under the brand name Delrin. Other suitable low friction material with high dimensional stability can be used.

The standoff latching portion 24, in FIG. 3, includes a hollow tube extending lengthwise, from the doorframe 18 to the elongated door pull handle 14, and proximate to the top edge along the user rotatable support standoff 20. A press fit plunger 36 extends from the doorframe 18 through the hollow tube of the standoff latching portion 24 and into the mounting plate 32 within the elongated door pull handle 14. This arrangement allows the user rotatable support standoff 20 to latch into either the locked or unlocked positions.

In FIG. 3, the door latch assembly 28 illustrated includes a two-point latch assembly 38. The two-point latch assembly 38 includes rods 40 that, in the latched position, extend through the doorframe 18 into the lintel or frame above the door and into the sill below the door. The door spindle 26 engages the two-point latch assembly 38. When the user rotates the user rotatable support standoff 20, the door spindle 26 rotates and engages the two-point latch assembly 38 in order to extend or retract the rods 40.

The fixed support standoffs 16 are illustrated in FIG. 3 securing the elongated door pull handle 14 to the doorframe 18 above and below the user rotatable support standoff 20. The fixed support standoffs 16 can be secured to the door handle by threaded fasteners 34 extending through hollow cavities 42 within the fixed support standoffs 16. The threaded fasteners 34 are of a type appropriate for securing the fixed support standoffs 16 to the elongated door pull handle 14. For example: wood screws for an elongated door pull handle 14 made of wood, machine thread screws for an elongated door pull handle 14 made of metal, or glass fastening screws for an elongated door pull handle 14 made of glass. The fixed standoffs can include apertures 44, as illustrated, on a mounting portion 46 that extends into the doorframe 18. The apertures 44 are configured to receive threaded fasteners to securing the fixed support standoff 16 to the doorframe 18.

Figure 4:
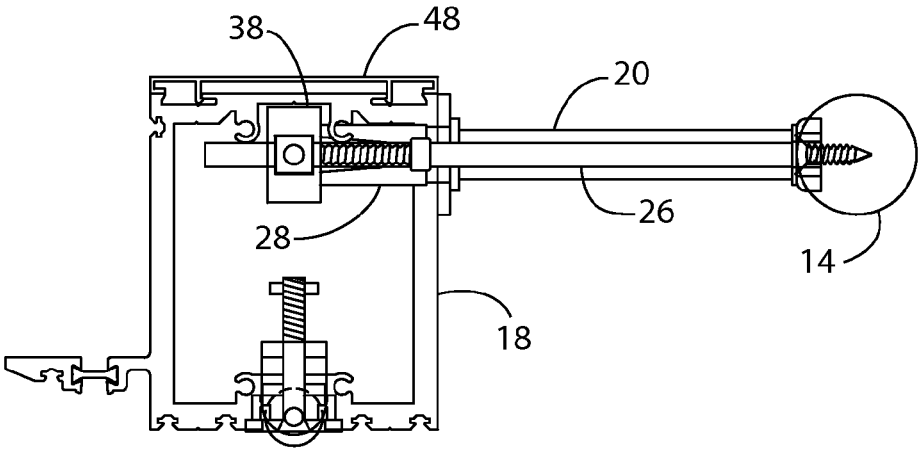
FIG. 4 shows a sectional view of a portion of FIG. 3 illustrating the user rotatable support standoff in cross-section.

FIG. 4 shows a sectional view of a portion of FIG. 3 illustrating the user rotatable support standoff 20 in cross-section. Illustrated is the door spindle 26 within the user rotatable support standoff 20 engaging the two-point latch assembly 38 within the vertical component of the doorframe 18. The user rotatable support standoff 20 is also shown in relation to the elongated door pull handle 14. The illustrated vertical component of the doorframe 18 includes a snap fit cover 48 for easy access for assembling and servicing the door latch assembly 28.

Figure 5:
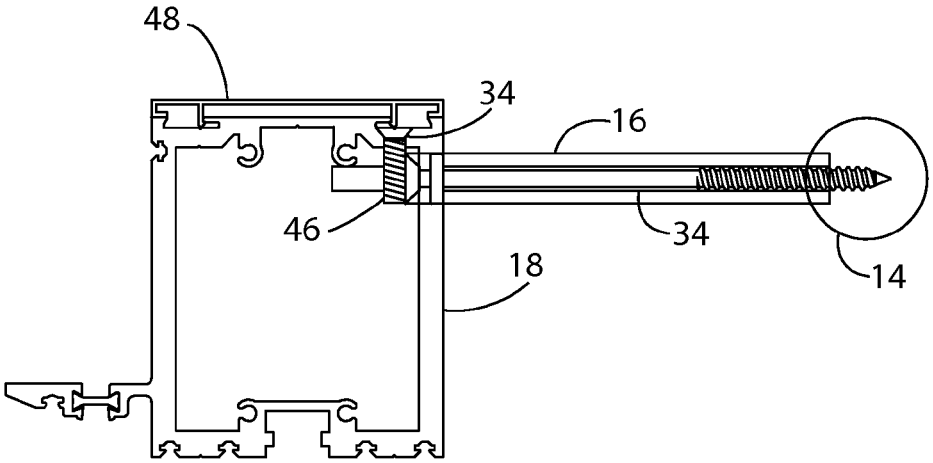
FIG. 5 shows a sectional view of a portion of FIG. 3 illustrating a fixed support standoff in cross-section.

FIG. 5 shows a sectional view of a portion of FIG. 3 illustrating a fixed support standoff 16 in cross-section with the threaded fastener 34 extending through the fixed support standoff 16 into the elongated door pull handle 14. A threaded fastener 34 is shown extending from an outer portion of the doorframe 18 into the aperture in the mounting portion 46 of the fixed support standoff 16. The head of the threaded fastener 34 is accessed by removing the snap fit cover 48.

Figure 6:
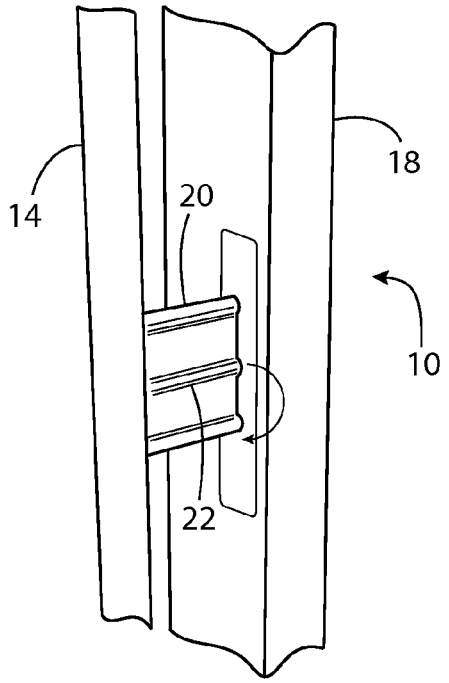
FIG. 6 shows a perspective view of a portion of a fixed door pull handle assembly with the user rotatable support standoff pivoting along a central longitudinal axis.

The user rotatable support standoff 20 of FIG. 2 is shown rotating around a pivot portion 22 located proximate to the bottom edge of the user rotatable support standoff 20. FIG. 6 shows a perspective view of a portion of a fixed door pull handle assembly 10 with user rotatable support standoff 20 including a pivot portion 22 approximately equidistant between opposing edges of the user rotatable support standoff 20. The portion of the fixed door pull handle assembly 10 illustrated shows the relationship between the elongated door pull handle 14 and the vertical portion of the doorframe 18. The axis of rotation of the user rotatable support standoff 20 is shown by an arc line with an arrow.

Figure 7:
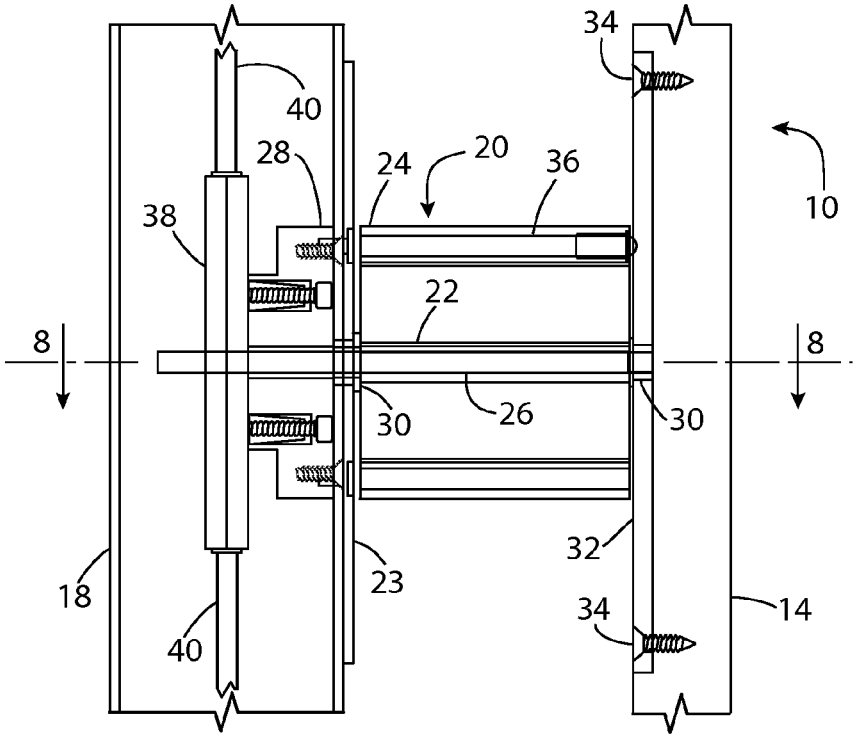
FIG. 7 shows a side cutaway view of FIG. 6.

FIG. 7 shows a side cutaway view of FIG. 6 of the fixed door pull handle assembly 10, including the elongated door pull handle 14, one of the vertical members of the doorframe 18 that surrounds the glass glazing, and the user rotatable support standoff 20, the door spindle 26, and door latch assembly 28. The user rotatable support standoff 20 is shown with the pivot portion 22 and a standoff latching portion 24. The pivot portion 22 includes a hollow tube extending lengthwise, from the doorframe 18 to the elongated door pull handle 14, and approximately mid-way between the bottom edge and the top edge of the user rotatable support standoff 20. The door spindle 26 extends through the hollow tube of the pivot portion 22 and the exterior of the door spindle 26 and the interior of the hollow tube of the pivot portion 22 are engaged in rotational captive cooperation as previously described. As the user pivots the user rotatable support standoff 20 the door spindle 26 also rotates.

The door spindle 26, as illustrated, is a square drive spindle. The interior cross-section of the hollow tube has a complementary cross-sectional shape. Other spindle exterior shapes and complementary hollow tube interior shapes can be used as previously discussed. One end of the door spindle 26 extends into the doorframe 18 and engages the door latch assembly 28 within the door and the bushing 30 mounted in the cover plate 23 and door latch assembly 28. The other end of the door spindle 26 extends into the bushing 30 within the elongated door pull handle 14. The bushing 30 within the elongated door pull handle 14 is mounted in the mounting plate 32. The mounting plate 32 is recessed within the elongated door pull handle 14 and secured to the elongated handle by threaded fasteners 34. The above-described arrangement allows the door spindle 26 to rotate freely within the elongated door pull handle 14 while at the same time, engaging the latching mechanism within the door latch assembly 28 as the use rotates the user rotatable support standoff 20 about the pivot portion 22.

The standoff latching portion 24, in FIG. 7, is configured in the same manner as FIG. 3 and includes a hollow tube extending lengthwise, from the doorframe 18 to the elongated door pull handle 14, and proximate to the top edge along the user rotatable support standoff 20. A press fit plunger 36 extends from the doorframe 18 through the hollow tube of the standoff latching portion 24 and into the mounting plate 32 within the elongated door pull handle 14. This arrangement allows the user rotatable support standoff 20 to latch into either the locked or unlocked positions.

The door latch assembly 28 illustrated includes a two-point latch assembly 38. The two-point latch assembly 38 includes rods 40 that, in the latched position, extend through the doorframe 18 into the lintel or frame above the door and into the sill below the door. The door spindle 26 engages the two-point latch assembly 38. When the user rotates the user rotatable support standoff 20, the door spindle 26 rotates and engages the two-point latch assembly 38 in order to extend or retract the rods 40.

Figure 8:
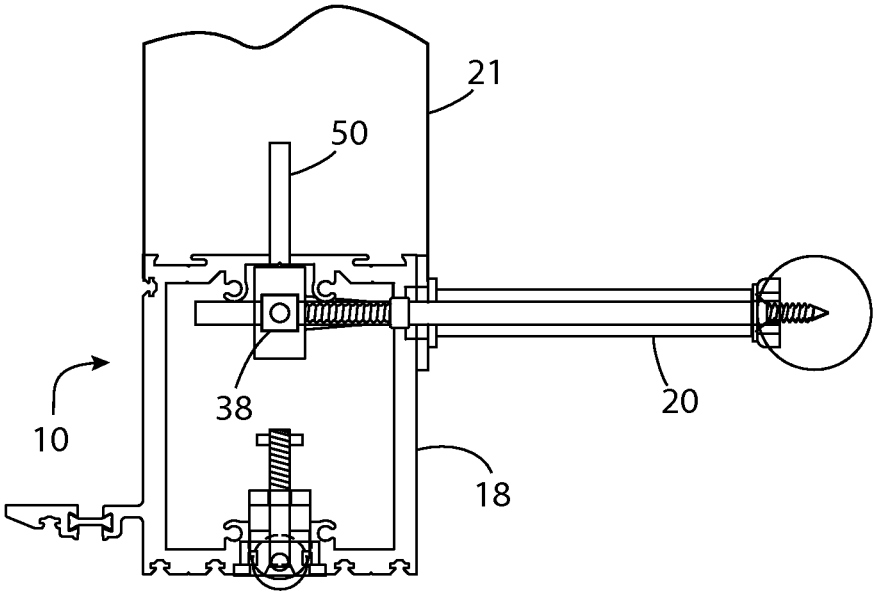
FIG. 8 shows a cross-sectional view of FIG. 7 including a deadbolt latch.

The door latch assembly 28 of FIG. 3 included a two-point latch assembly 38. The door latch assembly 28 can include other latching mechanisms, for example, a three-point latch assembly or a deadbolt latch. The door latch assembly 28 of FIG. 7 includes a dead bolt latch in addition to the two-point latch assembly 38. FIG. 8 shows a cross-sectional view of FIG. 7 including a deadbolt latch 50 in combination with the two-point latch assembly 38. When the user rotates the user rotatable support standoff 20 into the "lock" position, the deadbolt latch 50 extends through the doorframe 18 and secures the doorframe 18 to the doorjamb 21. When the user rotates the user rotatable support standoff 20 into the "open" position, the deadbolt latch 50 retracts back into the doorframe 18. While the fixed door pull handle assembly 10 of FIGS. 7-8 include a two-point latch assembly 38 in combination with a deadbolt latch 50, the two-point latch assembly 38 can be removed so that the fixed door pull handle assembly 10 is secured by only the deadbolt latch 50.

Figure 9:
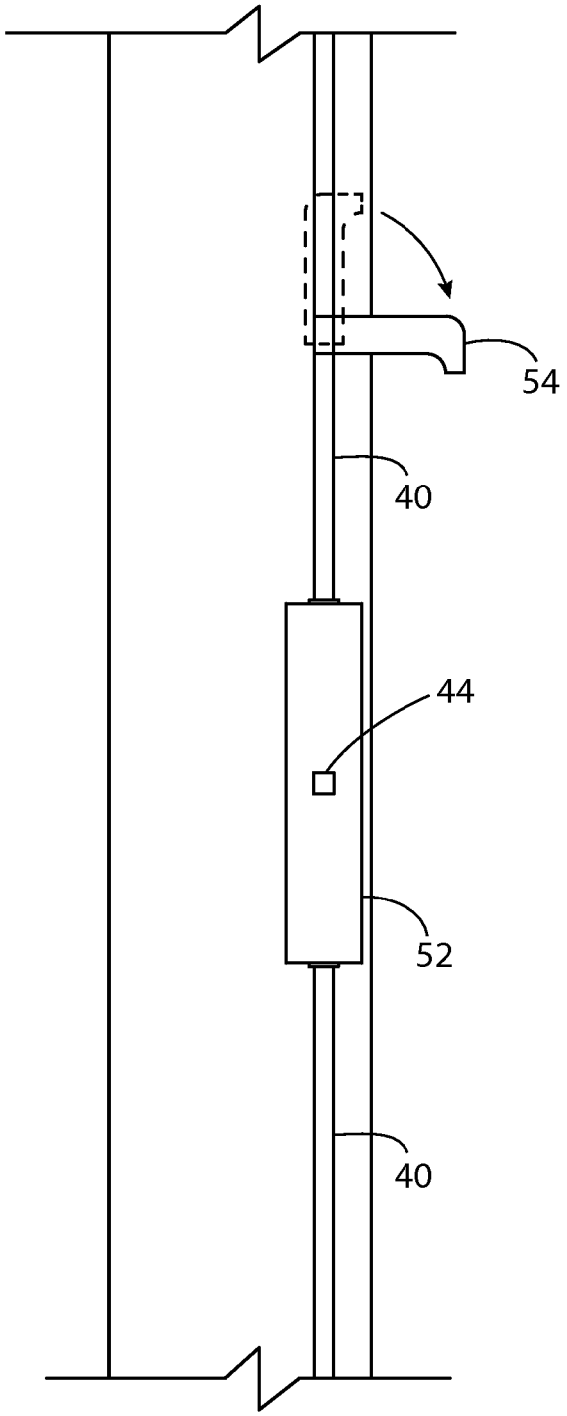
FIG. 9 shows an alternative three-point latch assembly.

FIG. 9 shows a three-point latch assembly 52. The three-point latch assembly 52 includes the rods 40 of the two-point latch assembly 38 of FIG. 7 and a swing hook 54. The three-point latch assembly 52 includes an aperture 44 adapted to receive the door spindle 26 of FIG. 3 or 7. As the rods 40 extend as a result of the user rotating the user rotatable support standoff 20 of either FIG. 2 or 6, as previously described, the swing hook 54 rotates into a horizontal latching position as illustrated. As the rods 40 are retracted, the swing hook 54 back to a vertical unlatched position.

Figure 10:
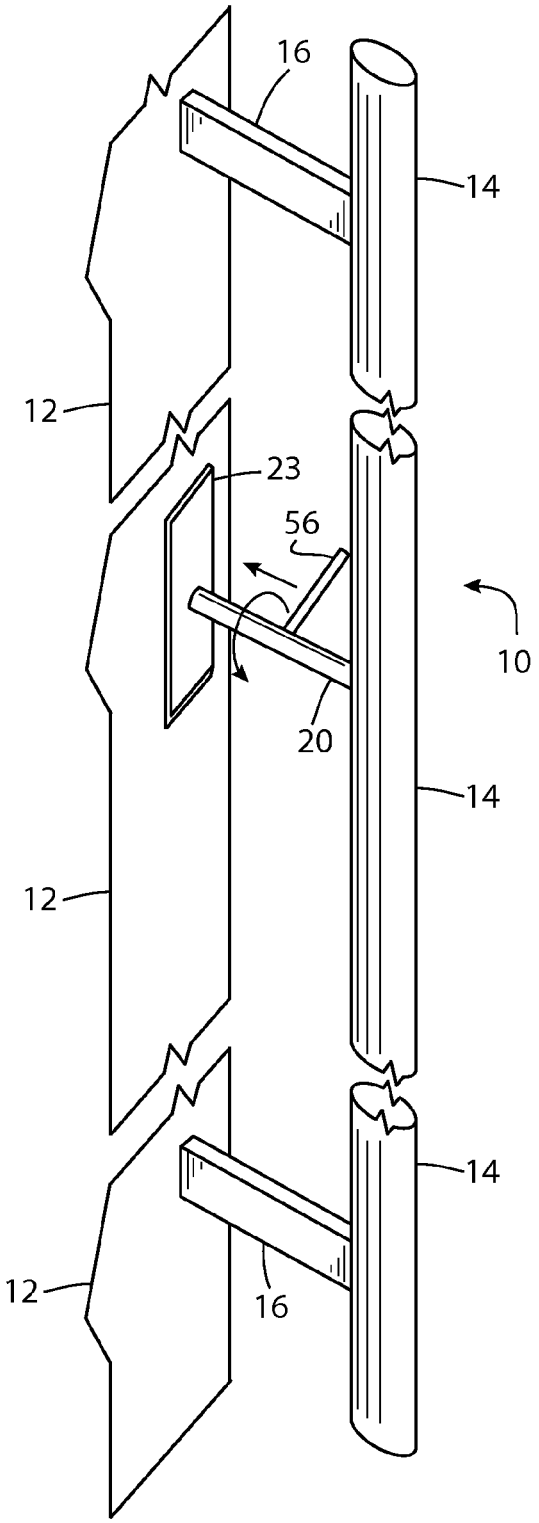
FIG. 10 shows a perspective view of an aspect of the disclosed fixed door pull handle assembly with an alternative version of the user rotatable support standoff.
Figure 11:
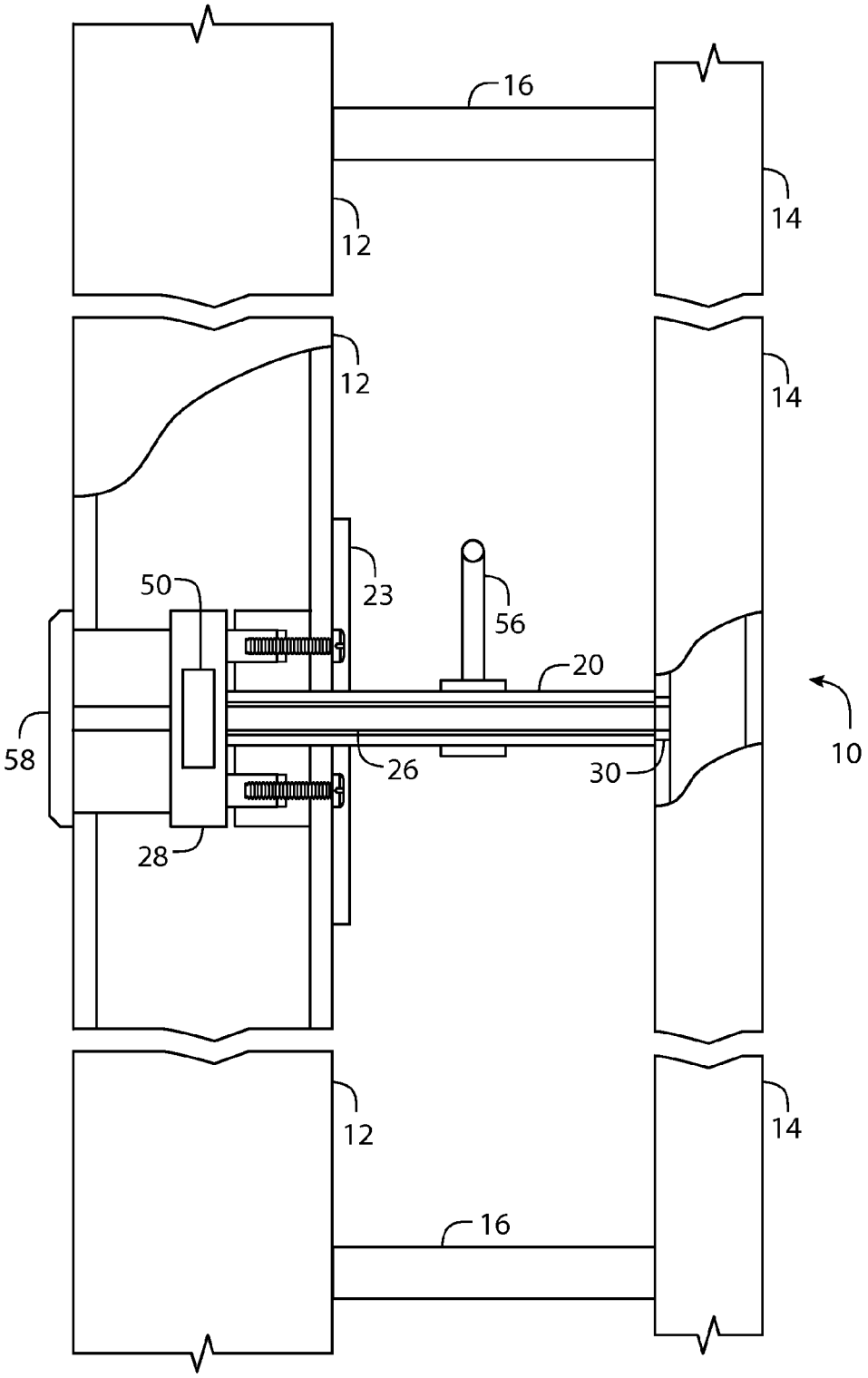
FIG. 11 shows a side cutaway view of the fixed door pull handle assembly of FIG. 10.

FIG. 10 shows a perspective view of an aspect of the fixed door pull handle assembly 10 with an alternative version of the user rotatable support standoff 20. FIG. 11 shows a side cutaway view of the fixed door pull handle assembly 10 of FIG. 10. In FIGS. 10-11, the user rotatable support standoff 20 is in the form of a flip lever or alternatively, a paddle handle. FIGS. 10-11 show the user rotatable support standoff 20, and the fixed support standoffs 16 securing the elongated door pull handle 14 to the door 12. The user rotatable support standoff 20 standoff engages the door 12 through the cover plate 23. The user rotatable support standoff 20 includes a flip lever handle 56 that allows the user to turn the user rotatable support standoff 20 into either the latched or open position. It may be desirable to immediate release the door lock or latch. The fixed door pull handle assembly 10 of FIGS. 10-11 can optionally accommodate this by providing a push-in lock-release mechanism. The flip lever handle 56, or alternatively a paddle bar handle, can be pushed forward toward the door, as illustrated in FIG. 10. The flip lever handle 56 is rigidly attached to the user rotatable support standoff 20 so the pushing motion moves the user rotatable standoff forward into the door recess and releases the door latch. This can be facilitated, for example, by a rack and pinion mechanism where the rack is either, attached to, or forms a part of, the door spindle 26 and the pinion facilitates engagement and disengagement of latching mechanism within the door latch assembly 28. The door spindle 26 is spring loaded so that after the user releases the flip lever handle 56, it automatically moves back to its original linear resting position and re-engages the latch mechanism. This push-in release mechanism can be utilized in commercial environments where building and fire/safety code requires the use of a panic bar for egress out of the building.

Referring to FIG. 11, the user rotatable support standoff 20 is shown as hollow tube. One end of the door spindle 26 extends through the user rotatable support standoff 20 into a bushing 30 within the elongated door pull handle 14. The other end of the door spindle 26 extends through the user rotatable support standoff 20 into the door latch assembly 28 and a key lock mechanism 58. The door spindle 26 and the user rotatable support standoff 20 are held in rotatable captive cooperation with each other. This can be accomplished by configuring the inside shape of the user rotatable support standoff 20 having a complementary shape to the door spindle 26. For example, the door spindle 26, can be a square drive and the inside profile of the user rotatable support standoff 20 can have a complementary square shape. The door latch assembly 28 includes a deadbolt latch 50 that extends and retracts as the flip lever handle 56 rotates the user rotatable support standoff 20 or alternatively by turning a key in the key lock mechanism 58.

Figure 12:
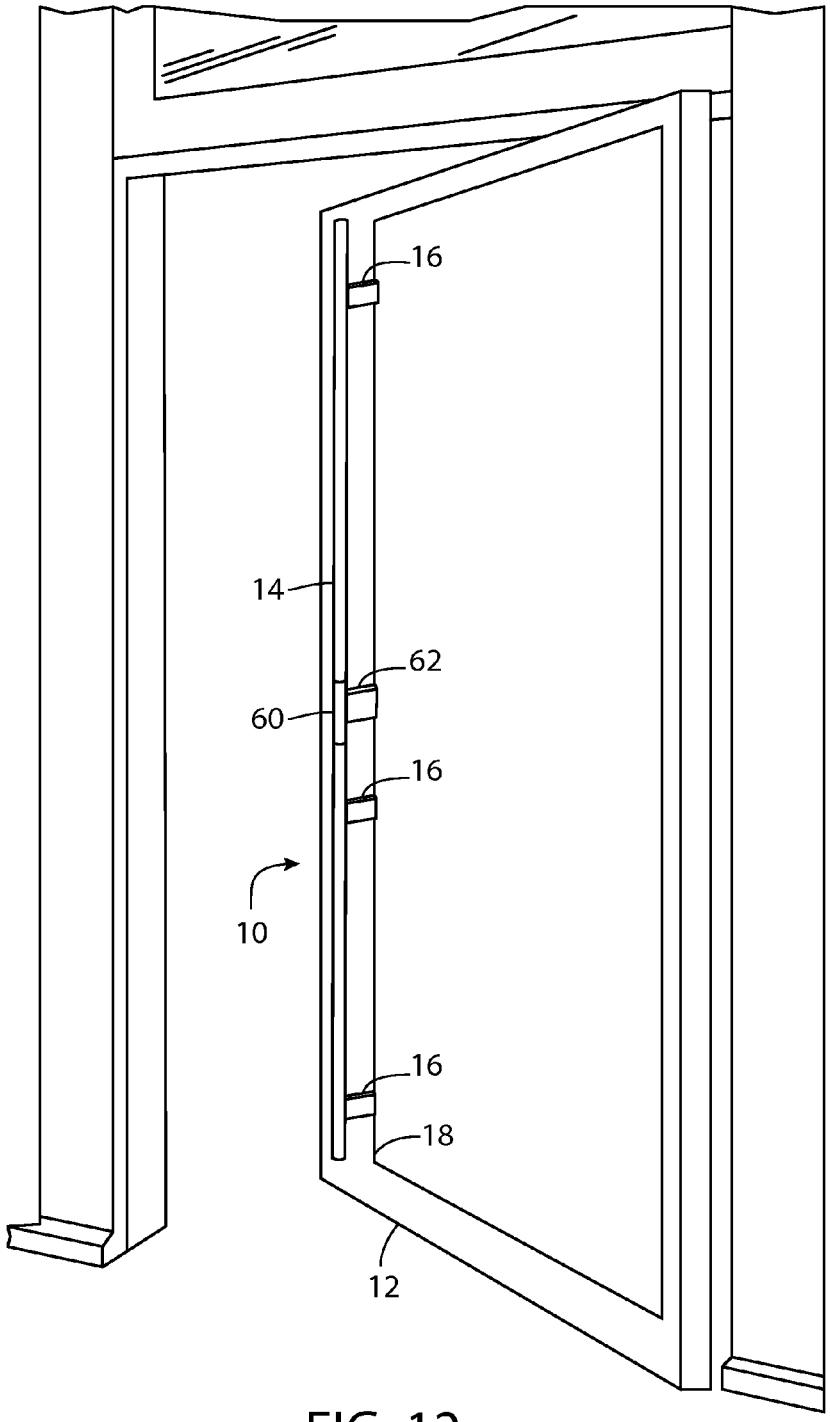
FIG. 12 shows an entry door including a fixed door pull handle assembly with a recessed center-pivoting handle embedded within the elongated door pull handle.

FIG. 12 shows a door 12 in the form of an entry door. The door 12 includes a fixed door pull handle assembly 10 with a recessed center-pivoting handle 60 embedded within the elongated door pull handle 14. The elongated door pull handle 14 is secured to the doorframe 18 surrounding the edge of the door 12 by the fixed support standoffs 16. A pivot-handle support standoff 62 secures the portion of the elongated door pull handle 14 that includes the recessed center-pivoting handle 60 to the doorframe 18.

Figure 13:
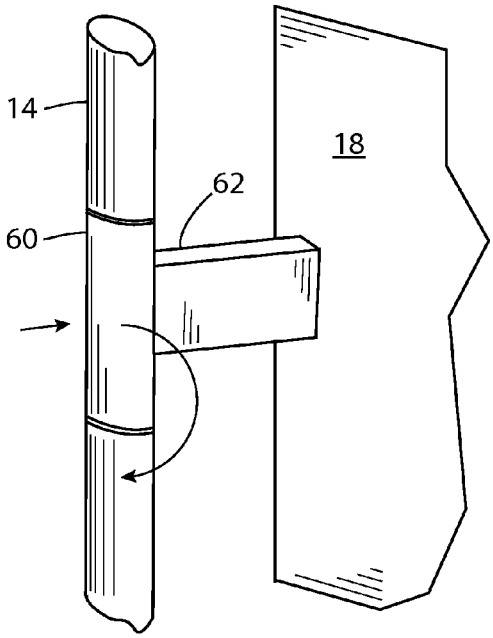
FIG. 13 shows a portion of FIG. 12 a detailed view the recessed center-pivoting handle embedded within the elongated door pull handle.
Figure 14:
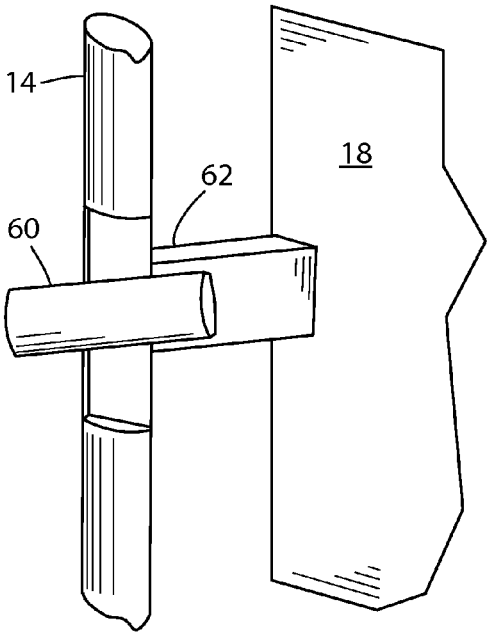
FIG. 14 shows the recessed center-pivoting handle rotated into a latching position.

FIG. 13 shows a portion of FIG. 12 showing a detailed view the recessed center-pivoting handle 60 embedded within the elongated door pull handle 14. FIG. 14 shows the recessed center-pivoting handle 60 rotated into a latching position. In FIGS. 13-14, the recessed center-pivoting handle 60 is shown in relation to the elongated door pull handle 14, the pivot-handle support standoff 62, and the doorframe 18. As previously discussed, it may be desirable to immediate release the door lock or latch, for example, where building and fire/safety code requires the use of as a panic bar for egress out of the building. As illustrated in FIG. 13, the recessed center-pivoting handle 60 can have a push release function in addition to a twist release in order to unlatch the door.

Figure 15:
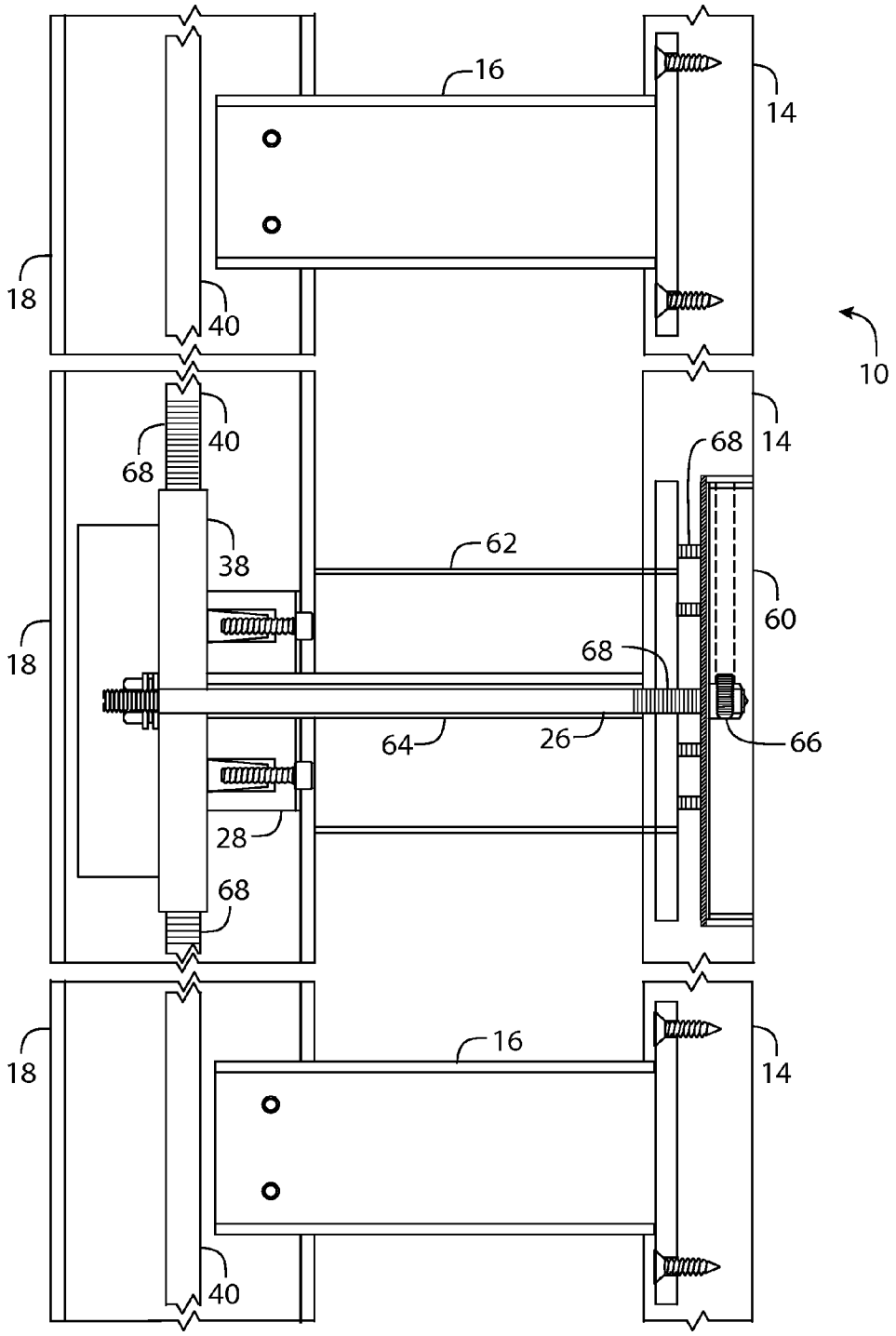
FIG. 15 shows a side partial cutaway view of the fixed door pull handle assembly of FIG. 12.
Figure 16:
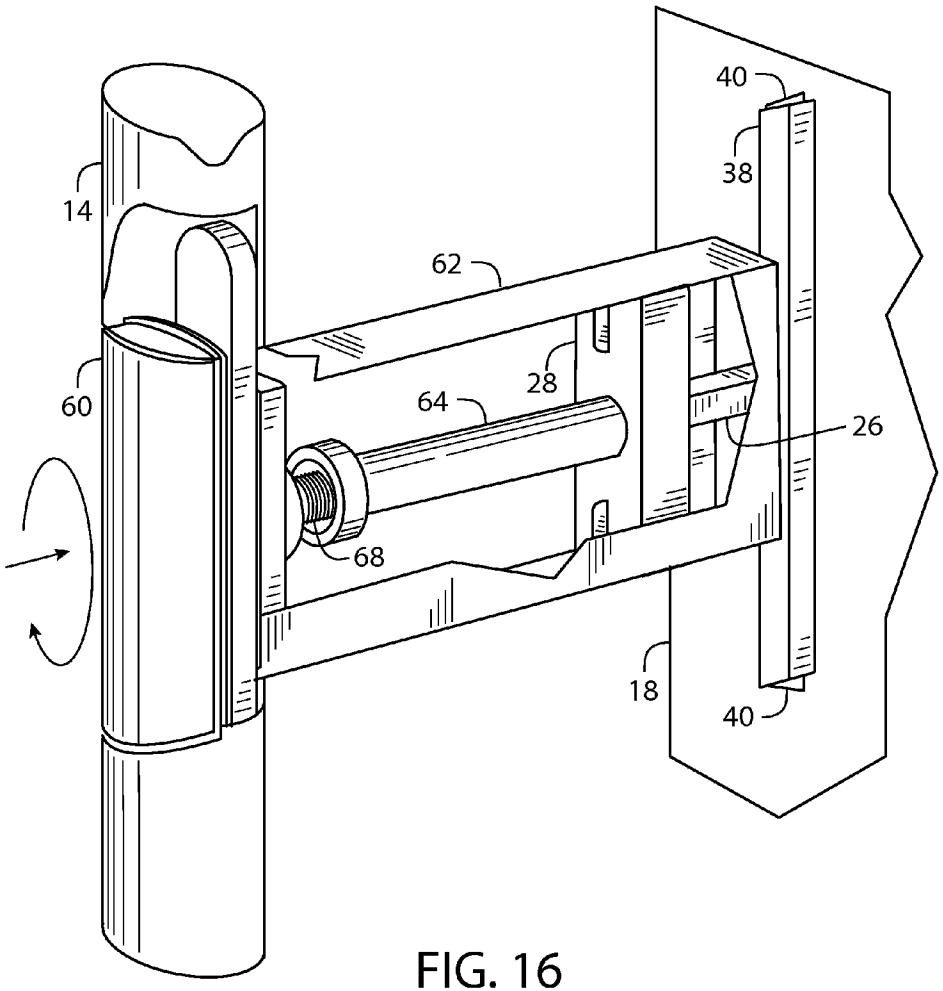
FIG. 16 shows a cutaway perspective view of FIG. 15.

FIG. 15 shows a side partial cutaway view of the fixed door pull handle assembly 10 of FIG. 12. FIG. 16 shows a cutaway perspective view of the pivot-handle support standoff 62 and recessed center-pivoting handle 60. Referring to FIGS. 15-16, the fixed support standoffs 16 are secured to the elongated door pull handle 14 and the doorframe 18 as previous described for FIGS. 3 and 7. The pivot-handle support standoff 62 includes a hollow sleeve 64 adapted to receive the door spindle 26 and it allow it to rotate freely. The door spindle 26 shown is a square drive. One end of the door spindle 26 extends through the door latch assembly 28 with a complementary square drive aperture and engages the two-point latch assembly 38 and the rods 40 associated with the two-point latch assembly 38. The other end of the door spindle 26 extends through the hollow sleeve 64 and into the recessed center-pivoting handle 60. The elongated door pull handle 14 includes a cutout shaped to receive and seat the recessed center-pivoting handle 60 so it appears to be approximately flush with the outward facing portion of the elongated door pull handle 14 when the door is in the unlatched position. In FIG. 15, the recessed center-pivoting handle 60 is shown attached to the door spindle 26 with a setscrew 66. The setscrew 66 is accessed through the side of the recessed center-pivoting handle 60.

The recessed center-pivoting handle 60 can optionally unlatch the door in "panic bar" style by pressing the recessed center-pivoting handle 60 toward the elongated door pull handle 14. This can be facilitated, for example, by a rack and pinion mechanism where the rack is either, attached to, or forms a part of, the door spindle 26 and the pinion facilitates engagement and disengagement of latching mechanism within the door latch assembly 28. Springs 68 between the back of the recessed center-pivoting handle 60 and the elongated door pull handle 14 push the center-pivot door handle back to its linear resting position after the users releases it and re-latches the door latch assembly 28. The rods 40 can also be spring loaded. FIG. 15 shows springs 68 surrounding the rods 40 with one end of the spring 68 resting against the body of the two-point latch assembly 38. The other end of the spring is held against the rod, for example, by a spring cup and lock nut.

Figure 17:
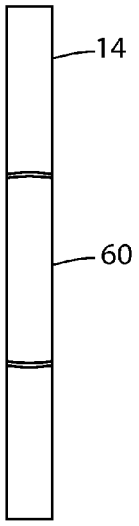
FIG. 17-19 show, in front view, the recessed center-pivoting handle applied to different lengths of the handle portion of the fixed door pull handle assembly.
Figure 18:
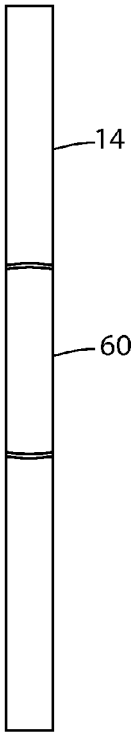
Figure 19:
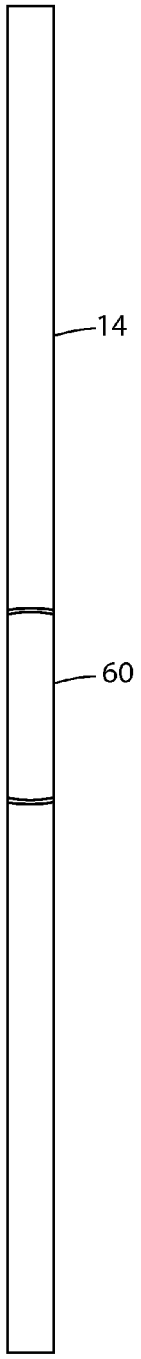

One of the advantages of the fixed door pull handle assembly 10 of FIG. 12 is that the same version of the recessed center-pivoting handle 60 can be applied to different lengths of elongated door pull handle 14. FIG. 17-19 shows, in front view, the recessed center-pivoting handle 60 applied to different lengths of elongated door pull handle 14.

A fixed door pull handle door assembly with an integrated door operator has been described. It is not the intent of this disclosure to limit the claimed invention to the examples, variations, and exemplary embodiments described in the specification. Those skilled in the art will recognize that variations will occur when embodying the claimed invention in specific implementations and environments. For example, it is possible to implement certain features described in separate embodiments in combination within a single embodiment. Similarly, it is possible to implement certain features described in single embodiments either separately or in combination in multiple embodiments. It is the intent of the inventor that these variations fall within the scope of the claimed invention. While the examples, exemplary embodiments, and variations are helpful to those skilled in the art in understanding the claimed invention, it should be understood that, the scope of the claimed invention is defined solely by the following claims and their equivalents.

What is claimed is:

1. A fixed door pull handle assembly, comprising:

an elongated door pull handle including an outward facing surface facing away from a door;

a first support standoff and a second support standoff, each projecting away from the elongated door pull handle along a corresponding axis of projection, suspending above the door a portion of the elongated door pull handle spanning therebetween, and rigidly securing the elongated door pull handle to the door;

a center-pivoting handle, including a top surface facing away from the door, the center-pivoting handle is positioned in-line with the second support standoff and recessed within the outward facing surface so that the top surface of the center-pivoting handle is either flush or below the outward facing surface; and the center-pivoting handle rotatably engages a door latch assembly within the door and rotates about an axis of rotation co-axial to the axis of projection of the second support standoff.

2. The fixed door pull handle assembly of claim 1, further including:

the second support standoff including a hollow interior portion;

a spindle, extending through the hollow interior portion and rotatably engaging the door latch assembly; and the center-pivoting handle and the spindle are in rotational captive cooperation.

3. The fixed door pull handle assembly of claim 2 further including:

a key lock mechanism; and the key lock mechanism rotatably engages the spindle.

4. The fixed door pull handle assembly of claim 1, wherein the door latch assembly within the door is a deadbolt latch.

5. The fixed door pull handle assembly of claim 1, wherein the door latch assembly within the door is a multi-point latch assembly.

6. The fixed door pull handle assembly of claim 1, wherein the door latch assembly within the door is a non-locking passage latch assembly.

7. The fixed door pull handle assembly of claim 1, wherein the center-pivoting handle disengages the door latch assembly when the center-pivoting handle is pressed.

8. The fixed door pull handle assembly of claim 1, wherein the first support standoff and the second support standoff each project directly away from the elongated door pull handle.

9. The fixed door pull handle assembly of claim 1, wherein the entire length of the elongated door pull handle is suspended above door.

* * * * *